United States Patent [19]

Freitas, Jr. et al.

[11] Patent Number: 5,063,298

[45] Date of Patent: Nov. 5, 1991

[54] IRRADIATOR FOR DOSIMETER BADGES

[75] Inventors: Joseph D. Freitas, Jr., BelleMead, N.J.; Yoshikazu Tatsumi, Roselle, Ill.; Hiroyuki Furukawa, River Edge, N.J.

[73] Assignee: Matsushita Electric Corporation of America, Secaucus, N.J.

[21] Appl. No.: 538,994

[22] Filed: Jun. 15, 1990

[51] Int. Cl.[5] ..... G21F 5/02

[52] U.S. Cl. ..... 250/497.1; 250/496.1

[58] Field of Search ..... 250/496.1, 497.1, 498.1, 250/503.1; 378/156

[56] References Cited

U.S. PATENT DOCUMENTS

| | | | |
|---|---|---|---|
| 2,872,586 | 2/1959 | Papanek | 250/496.1 |
| 3,225,203 | 12/1965 | Gombert | 378/156 |
| 3,659,106 | 4/1972 | Cason | 250/497.1 |
| 4,347,440 | 8/1982 | Haas | 378/156 |
| 4,467,198 | 8/1984 | Joffe et al. | 250/498.1 |

OTHER PUBLICATIONS

Product catalog from J. L. Shepherd and Associates. Model WE 2001 TLD Irradiator manufactured by Williston-Elin, Jan. 1989.

*Primary Examiner*—Bruce C. Anderson

*Attorney, Agent, or Firm*—Amster, Rothstein & Ebenstein

[57] ABSTRACT

An irradiator is disclosed for irradiating dosimeters type used to monitor environmental exposure or exposure of personnel to radiation. The irradiated dosimeters are used as standards against which dosimetry analysis equipment is calibrated. The invention provides an improved design for an irradiator which permits uniform irradiation of dosimeters over a wide range of radiation doses and which can provide both primary and secondary standards for calibration purposes. The irradiator includes a shielded housing designed with an optimum geometry to ensure uniform dosage across the face of the dosimeter, a filter to prevent undesirable scattered radiation from reaching the dosimeter during exposure, and a movable radiation attenuator to permit large differences in desired dose to be easily accommodated.

13 Claims, 5 Drawing Sheets

IRRADIATOR FOR DOSIMETER BADGES

The present invention relates to the field of dosimetry and in particular to a device for irradiating dosimeters with a known amount of radiation to produce standards against which other dosimetry equipment may be calibrated. The present invention provides an improved design for an irradiator which permits uniform irradiation of dosimeters over a wide range of radiation doses, and which produces dosimeters which can serve as both primary and secondary calibration standards.

BACKGROUND OF THE INVENTION

Personnel who work in environments in which exposure to either x-rays or nuclear radiation is possible are periodically monitored to determine if the radiation levels to which they have been exposed fall within established safety limits. In addition, environmental monitoring of radiation, as for example, ambient radiation levels in the vicinity of nuclear power plants, or background radiation resulting from naturally occurring sources, also requires the continuous monitoring over a period of time of low level radiation doses.

Monitoring of cumulative exposure to radiation is generally provided by a dosimeter. For monitoring of personnel, the dosimeter is usually configured in the shape of a small badge which may be clipped to a person's clothing and worn whenever there is a possibility of exposure to radiation. At periodic intervals, the dosimeter badges are collected and analyzed to quantitatively determine the amount of radiation exposure which they have accumulated during that time interval. Such monitoring is mandated by various governmental requirements for personnel working in nuclear power plants, radiology departments of hospitals, or in laboratories which utilize x-ray or nuclear radiation sources for experimental purposes.

By way of background, dosimeter badges have been developed in the prior art which utilize various detection materials. The simplest type of dosimeter is one which incorporates a small strip of photographic film within a light-tight enclosure. X-rays and/or other energetic nuclear radiations penetrate the enclosure to expose the film. The change in optical density of the film over the monitored time period is an indication of the total dose of radiation acquired by the film. Although film as a dosimeter material is inexpensive, it suffers from poor sensitivity at low dosages, and is of course not reusable after exposure.

To overcome these limitations, prior art dosimeters have also been developed which employ various types of solid state thermo-luminescent (TL) materials as the radiation dose accumulator. Irradiation of a TL material with x-rays or energetic nuclear radiation produces defect states in the material which trap electrical carriers generated therein. The number of trapped carriers is proportional to the total dose of radiation absorbed by the TL material over a period of time. To measure the accumulated dose, the TL material is heated to a temperature which releases the trapped carriers, causing them to produce characteristic luminescence (generally at infra-red wavelengths) which is optically monitored. The intensity of the luminescence is a measure of the total radiation dose which the TL material has received during the monitored time period. TL materials are generally more sensitive than photographic film to low doses of radiation, and can be reused after the TL material is heated.

To rapidly analyze the accumulated dosage of large numbers of thermo-luminescent dosimeter (TLD) badges, automatic analyzers or "readers" have been developed in the prior art. Such readers, for example, can make automatic measurements on five hundred TLD badges in three hours without manual operation. To quantitatively relate the measured thermo-luminescence intensity to the radiation dose, the sensitivity of the electronics in the readers must be calibrated against a "primary standard" dosimeter badge which has received an accurately known dose of radiation from a radiation source of known intensity.

Besides the need for overall calibration, in order to quantitatively analyze TLD badges, the reader must also properly correct for the variation in sensitivity between badges. Variations in sensitivity occur not only between different TL materials, but also as a result of variations in manufacture of the same TL material. Thus, prior to field use, each dosimeter is irradiated and measured against a standard which has been irradiated with the same dosage to determine a relative sensitivity factor for the dosimeter as compared to the standard. After the relative sensitivity is determined, the dosimeter is ready to be placed into field use. Upon subsequent analysis of the accumulated dose, the reader utilizes the relative sensitivity for the particular dosimeter being measured as a correction factor to determine the absolute dose.

In general, "primary standards", which have been irradiated with a precisely known dose of radiation are utilized to calibrate the electronics in the reader, and are handled carefully so that the properties of their TL materials do not change with storage. For more routine evaluation of relative sensitivities, so-called "secondary standards" may be used, since the absolute dose with which they are irradiated is not critical. All that is required is that the dosimeter whose relative sensitivity is being evaluated be irradiated to the same dose as the secondary standard.

The design of TLD badge readers is quite advanced. However, prior art irradiators for producing the requisite "primary standard" or "secondary standard" badges for calibration purposes are deficient from a number of practical perspectives. In one prior art irradiator, exemplified by a Model 142 irradiator manufactured by J. L. Shephard and Associates, dosimeters are manually positioned around the circumference of a large cylindrical housing having a radiation source (e.g. $^{137}Cs$) appropriately shielded in the center thereof. The radiation source is raised out of the shielded position to irradiate the badges with an accurately known dose of radiation. However, during irradiation the radiation source is completely unshielded, and as a consequence, personnel are not permitted to enter the room while the irradiator is operating. Although the open air design of this type of irradiator permits the production of "primary standards", the manual loading and unloading of dosimeters is time consuming, and the requirement that personnel cannot be within the same room during irradiation undesirably limits the type of location in which the irradiator can be installed.

A second type of prior art irradiator exists (manufactured by Williston-Elin Co. of South Africa) in which loading and irradiation of TLD badges are performed automatically. In this prior art irradiator, TLD badges are placed into a magazine capable of holding approximately fifty badges, which is then placed within a shielded tunnel. At the start of an irradiation cycle, the radiation source is raised from a shielded enclosure in which it is stored, and positioned in the middle of a shielded housing, where it remains until all the TLD badges in the magazine have been individually dosed. In this type of irradiator, mechanical assemblies similar in design to those used in automatic TLD badge readers sequentially raise each TLD badge out of its location in the magazine and into a position in close proximity to the radiation source, where it remains for a preset period of time. In this manner, each TLD badge is individually exposed to a controlled dose of radiation. Since the radiation source is at all times contained in a shielded housing, personnel can remain in the room during operation.

Although automating the movement of TLD badges into and out of a shielded housing, this type of prior art irradiator also suffers from a number of deficiencies. First, during irradiation, the TLD badge is positioned very close to the radiation source. This geometry is not at all optimal, and results in a non-uniform dosage across the TLD badge because the edges of the TLD badge, being somewhat farther from the source, receive less radiation than the central portion of the TLD badge.

Second, the TLD badge receives not only a known quantity of direct radiation from the radiation source, but also an unknown quantity of secondary radiation induced in the walls of the shielded housing by the radiation source and scattered in all directions. This scattered radiation generally consists of low energy x-rays which result from the interaction of the primary radiation emanating from the radiation source with the walls of the shielded housing. Lead shielding commonly used in the housing is particularly prone to generation of unwanted scattered radiation. The amount of scattered radiation may fluctuate with time, and is difficult to estimate in a quantitative manner. As a consequence, a TLD badge irradiated by this type of prior art irradiator cannot be used as a "primary standard", but only as a "secondary standard" for determining relative sensitivities.

A third deficiency in both types of prior art irradiators is that the radiation intensity incident on the TLD badges cannot be varied. This renders large dosage variations difficult to achieve in a time efficient manner. Variability of dosage is a feature many users consider to be important. For example, dosimeter applications involving environmental monitoring generally result in radiation doses which are approximately a factor of 10–100 times lower than the doses encountered during personnel monitoring. To achieve accurate dose measurements in the reader, it is necessary to provide calibrated standards dosed to approximately the same level as the dosimeters being monitored. Since there is no provision in prior art irradiators for attenuating the intensity of the radiation source, large variations in dosage can only be achieved by varying the irradiation exposure time over several orders of magnitude, or by physically changing the radiation source. Both of these approaches are undesirable.

SUMMARY OF THE INVENTION

It is an object of the present invention to overcome the deficiencies of prior art irradiators, and provide an improved irradiator apparatus which can automatically irradiate TLD badges with an accurately known dose and with improved dose uniformity across the TLD badge, thereby providing better quality standards to improve the overall accuracy of TLD badge reader systems.

It is a further object of this invention to provide an irradiator apparatus which incorporates a filter within the radiation path to eliminate the problem which arises when scattered secondary radiation produced by the irradiator housing is absorbed by the TLD badge. By eliminating this source of unknown dosage, a TLD badge dosed in an irradiator designed in accordance with the invention can serve as a primary calibration standard.

It is still another object of this invention to provide an irradiator apparatus which includes means for attenuating the radiation intensity emitted by the source. A larger range of radiation doses using the same radiation source can therefore be achieved without large variations in dosage time.

In accordance with the invention, these features are provided by an irradiator apparatus having a radiation shield housing with a channel provided therein, and a radiation source placed at on end of the channel for transmitting a radiation beam therethrough. The TLD badges are individually positioned at the other end of the channel during irradiation by automatically controlled positioning means in order to expose each TLD badge to a known amount of radiation. Interposed between the radiation source and the TLD badges is a filter material having radiation absorbing characteristics for absorbing the undesirable scattered radiation produced by the walls of the shielded housing. The irradiator of this invention further has a radiation attenuator, and means for operatively interposing said radiation attenuator between the radiation source and the TLD badges.

BRIEF DESCRIPTION OF THE DRAWINGS

For a fuller understanding of the nature, features and advantages of the present invention, reference should be made to the following detailed description of a preferred, but nonetheless illustrative embodiment of the invention, as illustrated and taken in conjunction with the accompanying drawings wherein.

DESCRIPTION OF THE PREFERRED EMBODIMENT

Figures 1, 2, 3:
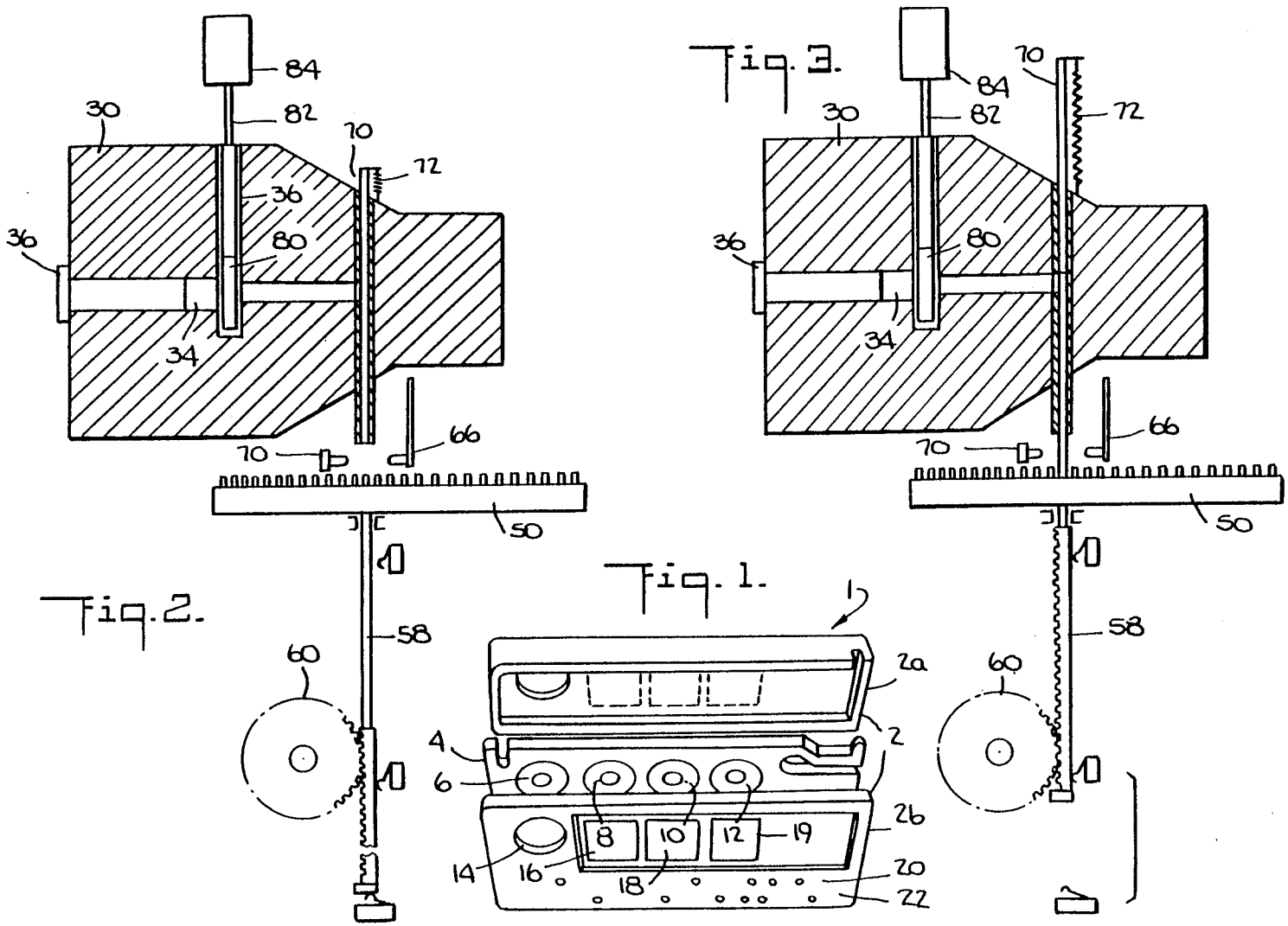
FIG. 1 is an exploded view showing the details of a thermoluminescent dosimeter badge which the preferred embodiment of the invention is designed to irradiate.
FIG. 2 is a side view of the shielded housing which contains the radiation source, showing the movable radiation attenuator, channel, filter tube and shutter included therein. Also schematically illustrated is a magazine containing thermoluminescent badges to be irradiated, and the major mechanical components which transport individual badges into the shielded housing. In this view, the shutter is shown in the closed position.
FIG. 3 shows the same side view and elements of FIG. 2, after a dosimeter badge has been automatically moved from the magazine and positioned along the radiation axis of the shielded housing, thereby extending the radiation shutter.

A more complete understanding of the irradiator of the present invention, and the improvements it represents over the prior art, may be obtained with reference to FIG. 1, which shows an exploded view of a prior art TLD badge 1 which the preferred embodiment of the invention is designed to irradiate.

The TLD badge 1 has an external housing 2 (shown as split in two halves 2*a*, 2*b*) and a slide 4 containing four circular regions 6, 8, 10, 12 in which various TL materials are located. For example, regions 6, 8 may both contain a copper-doped lithium borate TL material ($Li_2B_4O_7$:Cu). This lithium borate material has a radiation response characteristic which is very close to that of human tissue, and is responsive to x-rays and gamma rays over a wide range of energies. Further, because the lithium borate material is very thin, it permits an accurate measure of dosage to the skin. Regions 10, 12 of the TL dosimeter badge may contain a thulium-doped calcium sulfate TL material ($CaSO_4$:Tm). This material has very high radiation sensitivity, with the added advantage that low-energy x-rays and gamma rays can be separately detected by making use of the energy characteristics of the material.

During exposure and monitoring, the slide 4 containing these four regions 6, 8, 10, 12 is fully inserted within the housing 2. When so inserted, each of the four regions 6, 8, 10, 12 of the slide 4 is respectively positioned opposite four corresponding windows 14, 16, 18, 19 mounted on the housing 2. These windows are made of different materials through which radiation must travel before being absorbed by the corresponding TL materials. The materials for windows 14, 16, 18, 19 are chosen so that their respective radiation absorption properties, in combination with the absorption characteristics of their corresponding TL materials, are tailored to the monitoring requirements of the end user. As an example, the window materials may be various thicknesses of plastic, lead, etc. which properties coact with those of their corresponding TL materials to produce a particular sensitivity curve optimized to the energies and types of radiation being monitored.

In addition to the above features, the TLD badge has several rows of punched holes 20, 22, which may be punched by the badge distributor to encode each badge with a unique identification number. Not only is the identification (ID) number useful for keeping track of which TLD badge has been assigned to a particular person or location, but in addition, the measured relative sensitivity for that TLD badge is also associated with the ID number. As noted above, the relative sensitivity, as measured for each individual TLD badge, is used as a correction factor by the badge reader to properly quantify the accumulated dosage. Further, as will be explained more fully below, the ID code is also read and utilized by the TLD badge irradiator disclosed herein to keep track of the radiation history of each TLD badge.

Figure 4:
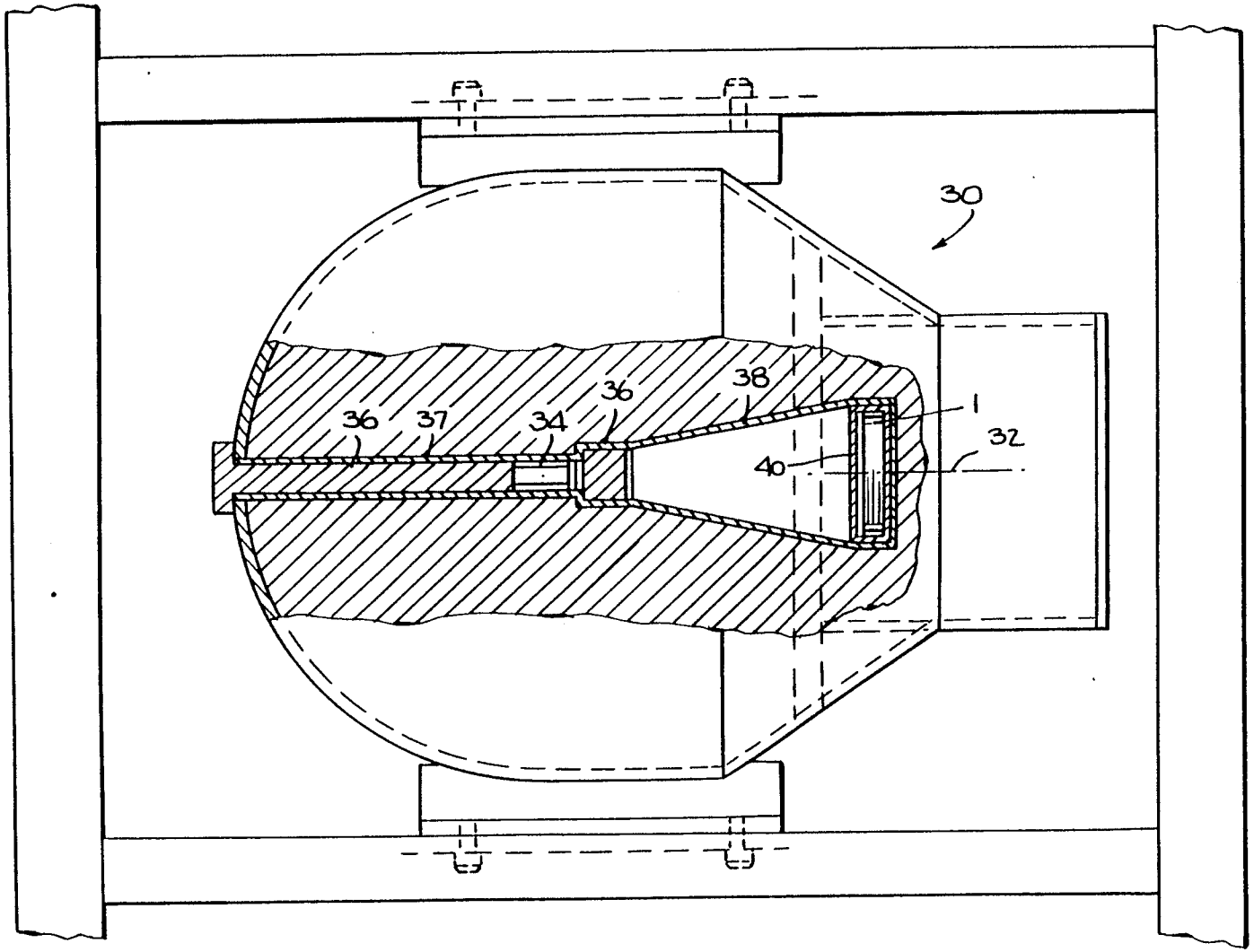
FIG. 4 shows a top view of the shielded housing in which a partial cross-section has been taken to illustrate the channels provided therein for permitting radiation to uniformly impinge on the dosimeter badge, which, as shown, is slidable positioned within the filter tube.

FIG. 4 generally shows a top view of an illustrative embodiment of one aspect of the invention, wherein a specially designed shielded housing or "castle" 30 contains a radiation source 34. The interior channels of castle 30 are shown in a partial cross-sectional view through the radiation axis 32 along which the radiation source 34 is placed. A shield plug 36 is provided in castle 30 for plugging a stainless tube 37 tube through which the radiation source 34 is initially inserted and positioned in the center of castle 30.

In the preferred embodiment of the invention, castle 30 is manufactured from a 70% lead/30% tungsten alloy. Although the shielding characteristics of tungsten are not as good as lead, use of a lead/tungsten alloy for the castle 30 results in reduced overall weight, and has the added advantage of a significantly higher melting temperature, thereby avoiding the risk that a pure lead castle might melt in the event of a fire. The radiation source in the preferred embodiment of the invention is a 5.0 Ci pellet of radioactive $^{137}Cs$, which can provide an unattenuated exposure rate of approximately 38 MR/sec across the face of the TLD badge.

Immediately adjacent to the radiation source 34 is a stainless steel guide channel 36 for accommodating a movable radiation attenuator 80 (shown schematically in FIGS. 2 and 3). Guide channel 36 has openings along the radiation axis 32 to allow unobstructed passage of the radiation emitted by radiation source 34.

As further shown in the cross-sectional view of FIG. 4, a stainless steel flared channel 38 extends laterally from the position of the channel 36 for a distance of approximately three inches and provides an open path through which the radiation may travel. Although fanning out horizontally to encompass the width of a TLD badge 1 (see the top view of FIG. 4), the flared channel 38 is of constant height, as shown in the side views of FIGS. 2 and 3. At the wide end of flared channel 38, the castle 30 is dimensioned to accommodate a filter tube 40 of Bakelite or other material having similar radiation absorbing properties. The filter tube 40 has a rectangular cross-sectional shape and an inner bore dimensioned to slidably receive a TLD badge 1. In the preferred embodiment, filter tube 40 is a sleeve which surrounds the TLD badge 1 when it is being irradiated. Filter tube 40 absorbs the low energy secondary radiation which is not directly produced by the radiation source 34. As explained above, this secondary radiation results from the interaction of radiation emitted by the radiation source 34 with the walls of castle 30. In the absence of filter tube 40, the secondary radiation which is produced and scattered off the interior walls of castle 30, would contribute an unknown dose of radiation to the TLD badge. Since the spurious secondary radiation consists mostly of low energy x-rays, a filter tube 40 of Bakelite or similar material is highly effective in absorbing such radiation, thereby ensuring that the TLD badges only receive the known dose from the radiation source 34.

The castle 30 extends to the right of filter tube 40 (as shown in FIG. 4) so that radiation which passes through the filter tube 40 and the TLD badge 1 positioned therein is appropriately stopped within castle 30. As a result of this overall design, the radiation levels external to the castle 30 are maintained at low enough levels so that the irradiator can be operated in any location, without adversely affecting personnel in its vicinity during operation.

Figure 5:
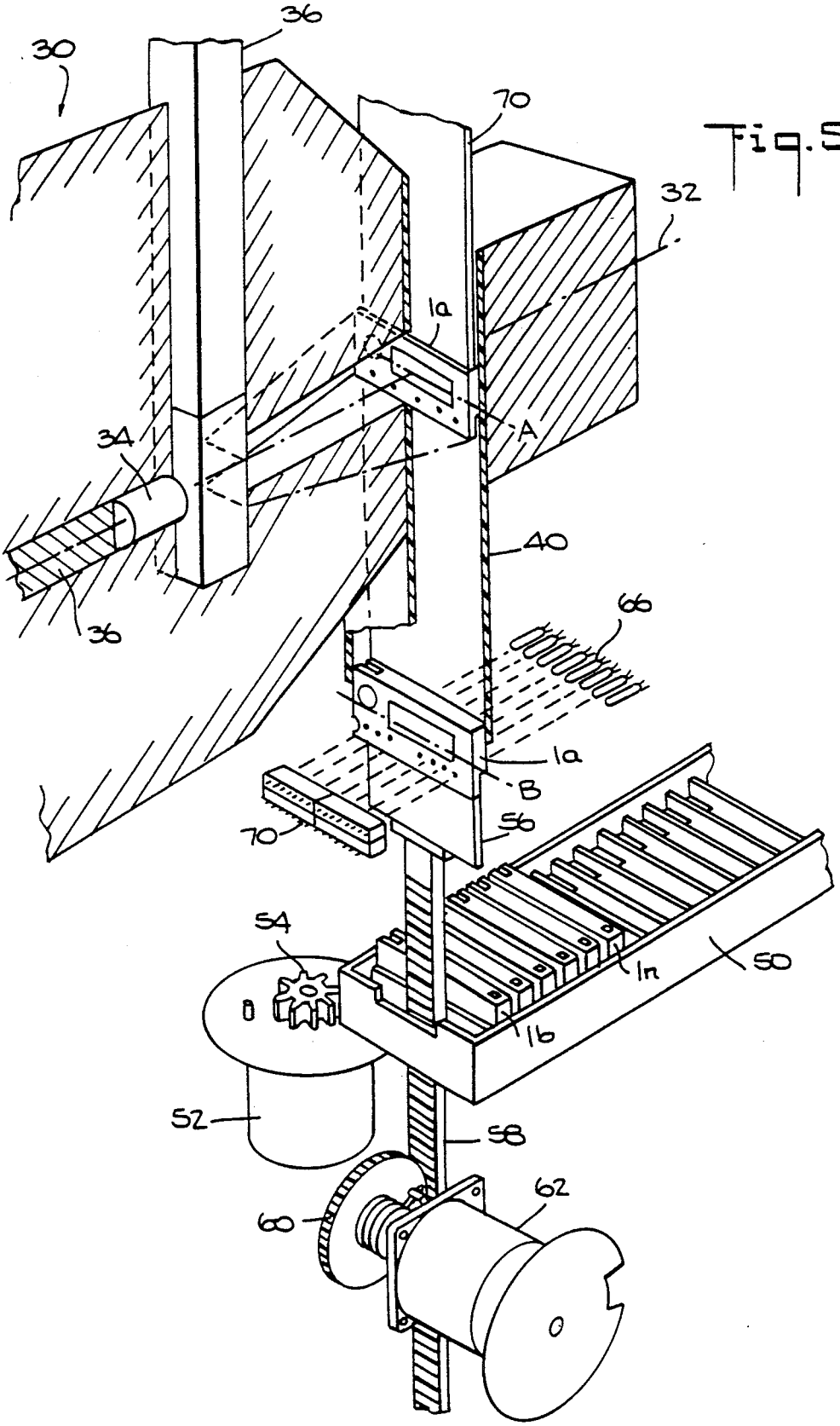
FIG. 5 shows a perspective cross-sectional view of the shielded housing, the filter tube, the magazine containing dosimeters, and the mechanical components which individually position a dosimeter badge at radiation position A. As shown, as the dosimeter badge moves into the filter tube, it intercepts an array of lamps and photodetectors which read the ID code on the badge.
Figure 6:
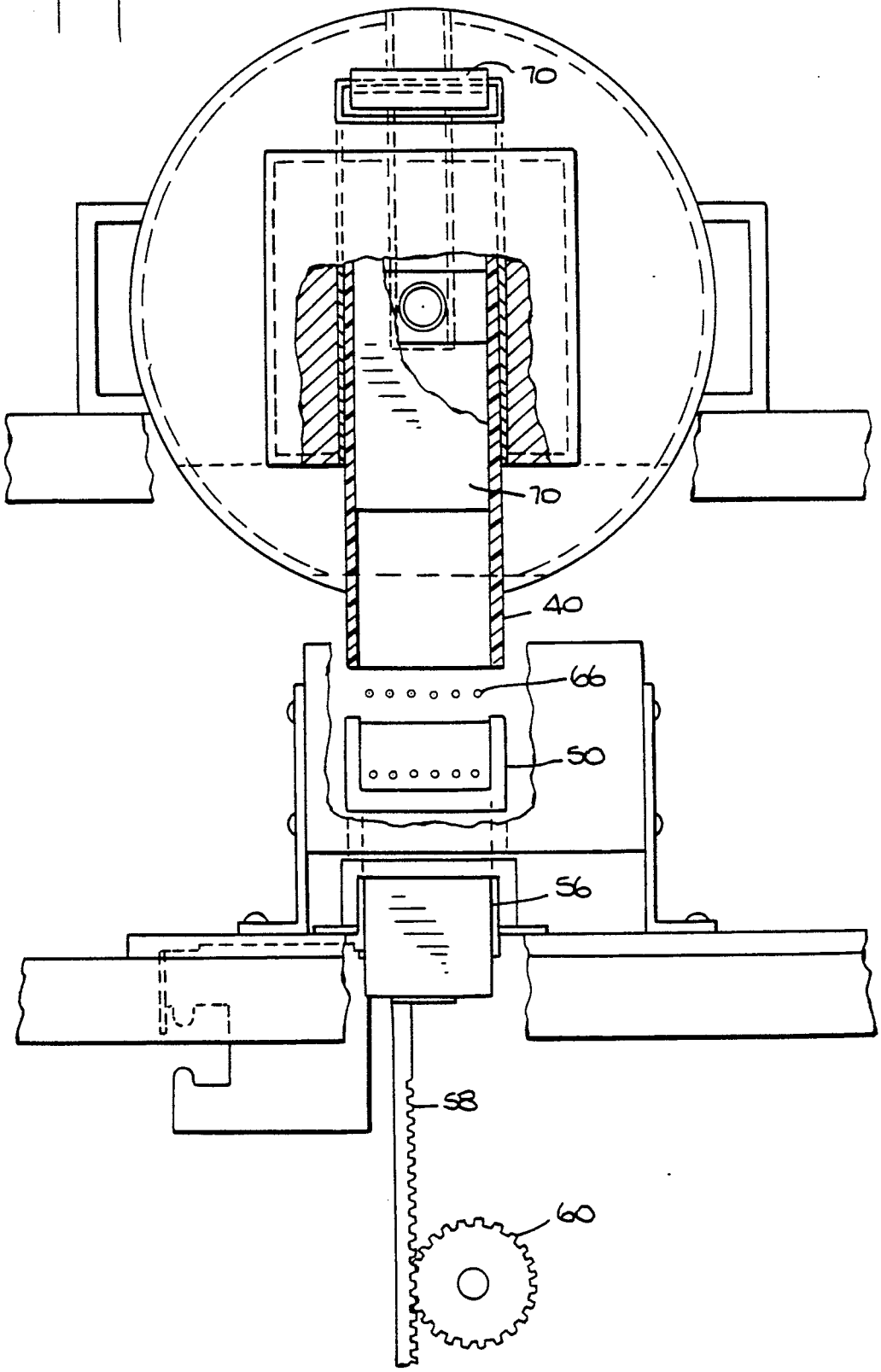
FIG. 6 is a side view of the irradiator, as viewed along the radiation axis, showing partial cross-sectional views of the filter tube and the shutter contained therein.

FIG. 5 shows a cross-sectional side view of the castle 30 and further schematically illustrates the major components of the mechanical assemblies which serve to automatically raise and lower individual TLD badges into position along the axis 32 of the castle 30 during irradiation. These assemblies are also shown in the side view of FIG. 6 which is a view looking down the radiation axis 32. As shown in FIGS. 5 and 6, individual TLD badges 1*a*, 1*b*, . . . 1*n* are loaded into slots of a magazine 50. Motor 52 drives a gear 54 attached to the end thereof in a stepwise fashion to advance the magazine 50 one slot at a time, thereby sequentially places each TLD badge into a loading position. The badge at the loading position, which for purposes of illustration is shown to be the first badge 1*a* in the magazine 50, is engaged by a tungsten lift plate 56 attached to rack 58. Gear 60 is driven by motor 62 so that the selected TLD badge 1*a* moves upwardly through the interior of filter tube 40 into irradiation position A. At position B, as the TLD badge begins its upward travel, it moves between an array of light sources 66 positioned opposite photodetectors 70, which read the ID code formed by the sequence of punched holes 20, 22 in the housing 2 of the TLD badge 1*a*.

Figure 7:
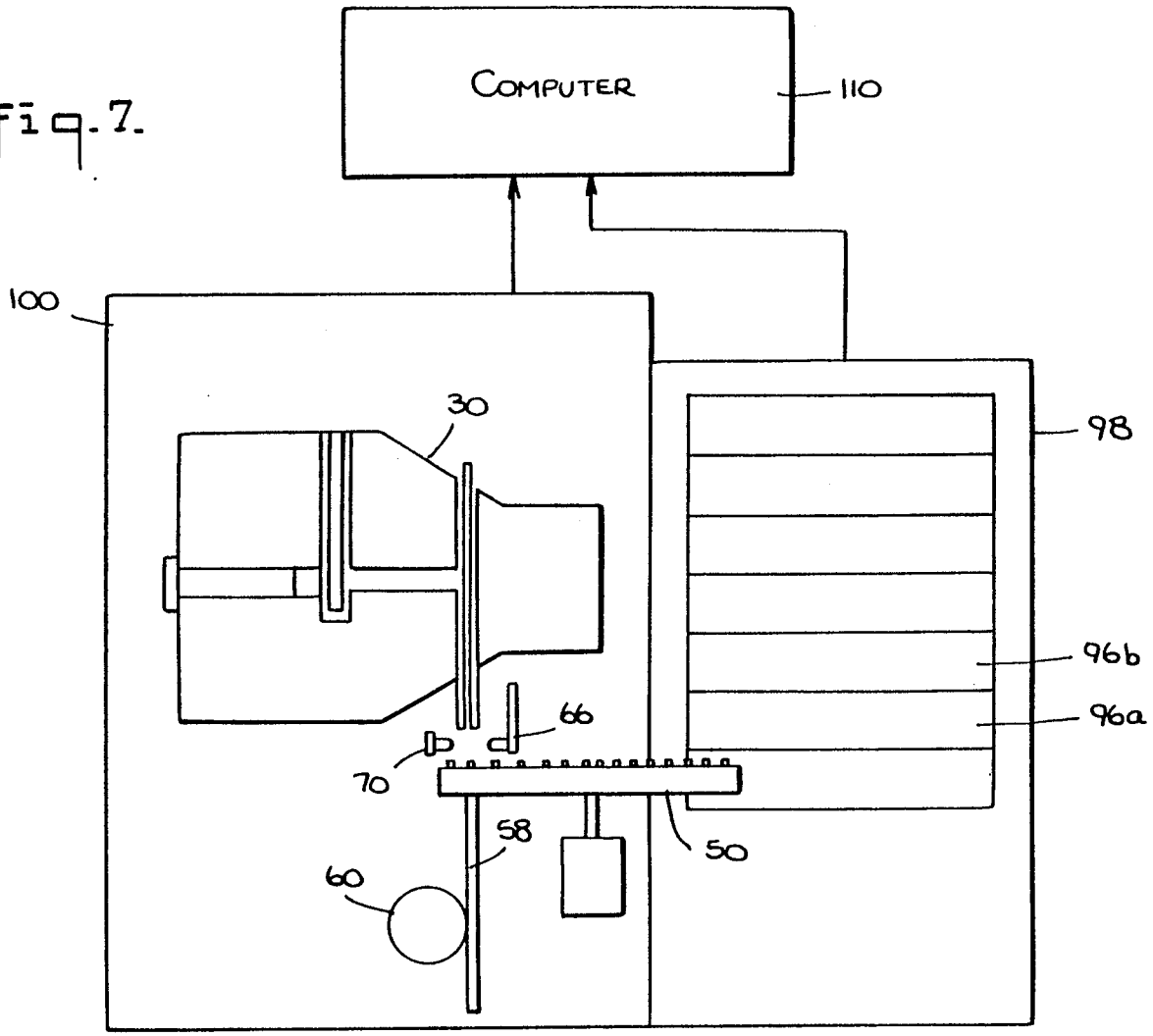
FIG. 7 is a schematic illustration of the irradiator, shown connected to an optional automatic magazine changer, with the functions of the irradiator and magazine changer being under computer control.

As shown in FIG. 7, the overall timing and control of the mechanical transport mechanisms of the irradiator apparatus 100 are under control of computer 110. The computer 110 stores the ID for each irradiated TLD badge, and associates with that ID the appropriate history of exposure time, etc. This information may be displayed, printed out, etc. for later analysis and record keeping purposes by peripheral equipment controlled by computer 110. The computer 110 also monitors the overall operation of the irradiator apparatus 100 and alerts the operator to any fault conditions which arise during operation. FIG. 7 also illustrates that the irradiator 100 may be optionally attached to an automatic magazine changer 98, which can accommodate a number of magazines 50. In this manner, when the irradiator apparatus 100 has completed the individual irradiation of all TLD badges in one magazine 50, the automatic magazine changer 98, under control of computer 110, will remove the magazine 50 from the irradiator apparatus 100, and replace it with another magazine 50 which has been pre-loaded with additional TLD badges requiring irradiation and stored in compartments 96*a*, 96*b*, etc. of the magazine changer 98. In this manner, multiple numbers of magazines can be moved into the irradiator 100 in a completely automatic and unattended manner.

In order to maintain a low ambient radiation level external to the castle 30, while still permitting entry and placement of the TLD badges into exposure position A, the castle 30 is further provided with a tungsten shutter 70, best illustrated with reference to FIGS. 2 and 3.

FIGS. 2 and 3 show vertical cross-sectional views of castle 30 and some of the components of the transport mechanism which move individual TLD badges from magazine 50 into castle 30 for irradiation. As shown in FIG. 2, castle 30 is provided with a shutter 70 which is biased in a closed position by spring 72. In the preferred embodiment of the invention, shutter 70 is a tungsten plate which can slidably move within the filter tube 40 to maintain the overall shielding integrity of castle 30. In FIG. 3, rack 58 is shown in its extended position, with a TLD badge 1 positioned within the castle 30 along radiation axis 32. As the TLD badge moves up through the filter tube 40 and into the irradiation position, it forces the tungsten shutter 70 to move upwardly, thereby extending spring 72. After irradiation, the TLD badge 1 is lowered back into its slot in magazine 50 and shutter 70 is spring biased back into the closed position.

FIGS. 2 and 3 also schematically show a radiation attenuator 80 of the preferred embodiment, which is attached by rod 82 to a solenoid 84 mounted external to the castle 30. When solenoid 84 is energized by an appropriate electrical signal from computer 110, the radiation attenuator 80 will move upwardly along guide channel 36 and out of the radiation path between radiation source 34 and the TLD badge 1. In the preferred embodiment, the radiation attenuator 80 is tungsten having a thickness chosen so as to reduce the intensity of the radiation transmitted therethrough to approximately one-tenth of its unattenuated value. As explained above, incorporation of a radiation attenuator 80 in the castle 30 makes it significantly easier to produce standards for both personnel monitoring, as well as environmental applications, having doses which vary by a large factor.

In operation, all aspects of the irradiation are performed under control of computer 110, with relevant input data such as the irradiation time or total dose desired, the position of the radiation attenuator 80, etc., being supplied by the operator. The presence of the magazine 50 is automatically sensed, and an automatic cycle is initiated by computer 110 which sequentially places each TLD badge from the magazine 50 into the castle 30 for a preset period of time, as described above. As shown in the end view of FIG. 6, as the TLD badge 1 begin its travel from the magazine 50, and before it completely enters filter tube 40, it passes between the array of lamps 66 and photodetectors 70 which sense the ID encoded on the TLD badge 1. This information, along with the radiation dose, is stored within the memory of computer 110 for later use by the reader. In this manner, highly accurate irradiations with high reproducibility can be performed on large number of TLD badges in a short period of time.

In summary, the irradiator disclosed herein removes several deficiencies found in prior art irradiator designs. First, by providing a flared channel and positioning the TLD badges undergoing irradiation at the flared end thereof, the dose uniformity across the width of the TLD badge is significantly improved over prior art designs in which the positioning of the TLD badge is not optimized. Second, by incorporation of a radiation attenuator, the radiation intensity of the radiation source may be quickly and automatically changed, thereby permitting TLD badges to be dosed over a wide range of doses. If standards are being produced for calibrating environmental badges, the radiation attenuator will be placed within the radiation path so that a range of low doses may be accommodated. On the other hand, if the irradiator is being used to provide standards which will be used to calibrate the reading of TLD badges used in personnel monitoring, the radiation attenuator 80 will be moved out of the radiation path, to allow the full strength of the radiation source to produce a high dose, without necessitating large changes in the irradiation time.

Finally, a significant advance in the irradiator disclosed herein, is the incorporation of a filter tube 40 through which the TLD badges pass, and through which they are irradiated. This tube serves the important function of eliminating the contribution to the dose of an unknown amount of radiation scattered by the walls of the shielded housing, thus permitting the production of primary standards. In the prior art, primary standards are produced by using an open air type of irradiator, with the attendant problem that the radiation source is completely unshielded during irradiation. Incorporation of the filter tube in the disclosed invention permits primary standards to be produced while maintaining safe shielding of the radiation source at all times. Accordingly, the irradiator described herein can be utilized in a factory or office environment, and meets all safety standards with respect to personnel working nearby.

Although the invention herein has been described with reference to particular embodiments, it is to be understood that these embodiments are merely illustrative of the different aspects and teachings of the invention. As such, persons skilled in the art may make numerous modifications to the illustrative embodiment described herein and other arrangements may be devised to implement the invention without departing from the spirit and scope of the invention as described above and claimed herein.

What is claimed is:

1. An apparatus for uniformly irradiating a plurality of materials with a known dose of radiation comprising:

(a) a radiation shield housing having a channel provided therein;

(b) a radiation source placed at one end of said channel for transmitting a radiation beam therethrough;

(c) means for positioning at least one of said plurality of materials at the other end of said channel, said means for positioning being controlled to expose each of said plurality of materials to said known dose of radiation;

(d) a radiation attenuator for reducing the intensity of said radiation beam to obtain a lower dose rate;

(e) means for interposing said radiation attenuator between said radiation source and said one material positioned at said other end of said channel to select said lower dose rate; and (f) a filter means interposed between said radiation beam and said one material to prevent undesirable radiation generated in said radiation shield housing from impinging upon said one material during irradiation thereof.

2. The apparatus of claim 1, further including a shutter at said other end of said channel to block said radiation beam, said shutter being opened to expose said materials positioned at said other end of said channel to said radiation transmitted therethrough.

3. The apparatus of claim 1, wherein said shutter is tungsten.

4. The apparatus of claim 1, wherein said radiation shield housing comprises a lead/tungsten alloy.

5. The apparatus of claim 1 wherein said filter means comprises a radiation absorbing sleeve which surrounds said material during irradiation.

6. The apparatus of claim 1, wherein said filter means is a radiation absorbing sleeve of Bakelite material which surrounds said material during irradiation.

7. The apparatus of claim 1, wherein said radiation attenuator is tungsten.

8. An apparatus for uniformly irradiating a plurality of dosimeter badges with a known and uniform dose of radiation comprising:

a) a radiation shield housing having a channel provided therein;

b) a radiation source placed at one end of said channel for transmitting a radiation beam therethrough;

c) means for positioning at least one of said plurality of dosimeter badges at the other end of said channel, said means for positioning being controlled to expose each of said plurality of dosimeter badges to a known amount of radiation;

d) a radiation attenuator;

e) means for interposing said radiation attenuator between said radiation source and said one of said one of said dosimeter badges; and f) a filter means interposed between said radiation beam and said dosimeter badges to prevent undesirable radiation from impinging thereon during irradiation.

9. The apparatus of claim 8 wherein said filter means is a radiation absorbing sleeve which surrounds each of said dosimeter badges during irradiation.

10. The apparatus of claim 8 wherein said filter means is a radiation absorbing sleeve of Bakelite material which surrounds each of said dosimeter badges during irradiation.

11. The apparatus of claim 8, wherein said radiation attenuator is tungsten.

12. A method for uniformly irradiating a dosimeter badge with a known and uniform dose of radiation comprising the steps of:

(a) providing a radiation shield housing having a channel contained therein;

(b) placing a radiation source at one end of said channel for transmitting a radiation beam therethrough;

(c) positioning said dosimeter badge at the other end of said channel for a predetermined time period to expose said dosimeter badge to a known amount of radiation; and (d) interposing a filter means between said radiation beam and said dosimeter badge during irradiation to prevent undesirable radiation generated in said radiation shield housing from impinging on said dosimeter badge during irradiation thereof.

13. The method of claim 12 which includes, prior to irradiation, the step of interposing a radiation attenuator between said radiation source and said dosimeter badge to select a lower radiation dose rate.

* * * * *